United States Patent [19]

Parker

[11] Patent Number: 4,865,283

[45] Date of Patent: Sep. 12, 1989

[54] MERCHANDISING DISPLAY STAND

[76] Inventor: Robert J. Parker, 805 E. Molar Ave., Martinsburg, W. Va. 25401

[21] Appl. No.: 33,794

[22] Filed: Apr. 3, 1987

[51] Int. Cl.[4] ..... F16M 13/00

[52] U.S. Cl. ..... 248/159; 108/111; 211/133; 211/163; 211/163; 211/205; 248/150; 248/221.4; 248/415

[58] Field of Search ..... 248/165, 159, 150, 415, 248/221.4; 211/205, 196, 193, 133, 131, 94, 162, 163; 108/151, 111, 150

[56] References Cited

U.S. PATENT DOCUMENTS

| | | | |
|---|---|---|---|
| 923,705 | 6/1909 | Reyher | 211/162 X |
| 2,937,766 | 5/1960 | Penn | 211/193 |
| 2,941,669 | 6/1960 | Palay et al. . | |
| 3,102,638 | 9/1963 | Saunders | 248/159 X |
| 3,339,752 | 9/1967 | Trogan | 248/159 X |
| 3,469,708 | 9/1969 | Pennington . | |
| 3,583,568 | 6/1971 | Crosslen . | |
| 3,756,421 | 9/1973 | Wilkins . | |
| 3,788,489 | 1/1974 | Levinthal . | |
| 3,805,965 | 4/1974 | Champagne . | |
| 3,851,602 | 12/1974 | Davis | 108/111 X |
| 3,921,813 | 11/1975 | Cimino . | |
| 3,998,334 | 12/1976 | Smith . | |
| 4,211,331 | 7/1980 | Salmon et al. . | |
| 4,219,172 | 8/1980 | Murayama | 248/211.4 X |
| 4,289,246 | 9/1981 | Scott | 211/205 |
| 4,614,272 | 9/1986 | Shelton et al. . | |
| 4,678,089 | 7/1987 | Lang | 211/205 X |
| 4,736,856 | 4/1988 | Alneng et al. | 211/163 |

FOREIGN PATENT DOCUMENTS

| | | | |
|---|---|---|---|
| 211816 | 2/1987 | European Pat. Off. | 211/131 |
| 2019457 | 11/1971 | Fed. Rep. of Germany | 211/205 |

*Primary Examiner*—Alvin C. Chin-Shue
*Assistant Examiner*—David L. Talbott
*Attorney, Agent, or Firm*—Dowell & Dowell

[57] ABSTRACT

A multi-component merchandizing stand having tiered article support racks and/or trays which are interchangeably mounted for rotational movement with respect to a vertical support column so that a plurality of varied items may be selectively arranged and displayed from a common support base.

18 Claims, 3 Drawing Sheets

MERCHANDISING DISPLAY STAND

BACKGROUND OF THE INVENTION

1. Field of the Invention

This invention is generally directed to support or display stands for displaying articles of merchandise in retail establishments and more particularly to a display stand having interchangeable article support components which are either directly rotatably mounted to a vertical support assembly or are removably mounted to brackets which are rotatably mounted to the vertical support assembly. The article display stand is designed to permit a plurality of different types of merchandise to be displayed from a common support which is assembled and disassembled without requiring the use of tools. Each of the display hooks, racks and/or trays is carried in rotational relationship with respect to the vertical support so as to enable merchandise supported thereby to be rotated through an entire circle thereby enabling the merchandise to be displayed along the entire periphery of each display stand.

In a preferred embodiment of the invention, the merchandise elements are removably mounted to brackets which are rotatably carried by the vertical support assembly of the display apparatus. The support elements are designed to be slideably engaged with respect to the support brackets in such a manner that the support elements may be selectively spaced to alter the display of merchandise supported on the stand.

The tiered display stand of the present invention includes a plurality of vertically interlocking post members each of which includes an upper bearing surface for supporting the article support components so that such components are rotatably mounted with respect thereto and are selectively arrangeable by the merchandiser depending upon the space, location and effect to be achieved using the display stand in a given area.

2. History of the Related Art

One of the key factors in successful merchandising is the creation of an artistic display which allows the merchandise to be set off in such a manner as to be immediately recognizable and accessible to the consumer. Numerous inventions have been directed to various stands and display devices for supporting articles of merchandise in a store or other commercial environment. There have been numerous stands developed which are floor supported and in which folded, draped, suspended or other types of merchandise may be supported in order to be viewed by the consumer. The primary purpose is to make merchandise readily available to potential purchasers in a compact and imaginative arrangement.

In some environments, display stands are specifically designed to set off or emphasize the merchandise being displayed. For instance, in jewelry stores and the like, large display stands are generally frowned upon. Instead, use is made of tastefully arranged countertop display stands for supporting earrings, chains and other articles. Such smaller stands are preferred as the entire theme of the retail establishment is one of elegance and delicacy about the articles which are being sold. On the other hand, in larger retail establishments in which a plurality of varying types of merchandise are displayed, it is generally preferred to provide as much display space in a single stand as is possible so that as much merchandise is made available to the potential consumer as is possible without requiring additional floor or counter space. This is particularly true in view of the high cost of retail space in most areas.

It is therefore important in the display of retail goods to provide a pleasant display which meets the particular needs of a retail establishment and which functions to display the articles of merchandise in a manner commeserate with the types of goods being offered for sale.

Generally, most display stands which have been designed and constructed have been directed to specific articles of manufacture and are therefore not appropriately designed to function as display stands for a plurality of differently styled goods which may be offered for sale in various commercial establishments. For instance, a standard key chain or novelty type countertop display may take the shape of a rotating display rack having a central post which is rotatably mounted to a base. The rotatable rack may include a plurality of outwardly extending and vertically spaced support arms or hanger elements upon which merchandise is supported. Such a display permits merchandise to be suspended totally around the rack thereby saving valuable counter or shelf space. The consumer need only rotate the rack in order to view one of the articles carried around the perimeter thereof. In addition, such racks enable merchandise to be displayed in a tandem relationship along each of the article support hook and in vertically spaced relationship with respect to one another around the rotatable support column. Unfortunately, such display stands utilize a single type of support arm or hook and are designed to support only specific types of similar items. For example, such prior art display stands include a plurality of arms of similar design upon which similar types of articles are supported such as blister packs having a shaped opening through a backing surface so that the support arms fit through such openings. Therefore, such prior art display devices are not designed to display a plurality of differently packaged and/or shaped goods on a single rotatable column.

Other prior art display stands are of a type which may include a plurality of horizontally oriented and vertically spaced rotatable shelf elements which support loose items of merchandise or layered items of merchandise depending upon the particular nature of the items being displayed. For instance, in many retail establishments, seed packages and other type thin package displays are mounted in horizontally oriented rotatable racks with each package of a particular variety being tandemly oriented. By rotation of each of the shelves of the rack, a consumer may select a given package. Again, however, the entire stand or rack is configured to support similar items, and therefore, each of the shelf elements is structurally similar and not designed for use with a variety of differently styled or differently packaged consumer items.

Other conventional display stands are specifically designed to be floor mounted. These types of stands are not adequate for the use of a retailer in displaying small articles or consumer goods in confined areas or along countertop areas as discussed above with respect to the merchandiser in the jewelry business. In addition, such stands are not easily disassembled or rearranged in order to change the component parts thereof and thereby create different visual displays.

The most frequently used display stands which most consumers encounter are of a fixed type and are only alterable by adjusting the merchandise support elements themselves. Such display devices may include a pegboard material having a plurality of hook or shelf elements adjustably supported therein. The hook or shelf elements may be adjusted vertically and horizontally with respect to one another depending upon the type of merchandise which is to be supported thereon. Unfortunately, such fixed displays do not permit a rotational movement of the display and are also not condusive for both floor or countertop use.

Some example of prior display stands include U.S. Pat. Nos. 2,941,669 to Palay et al; 3,266,634 to Tintary; 3,469,708 to Pennington; 3,583,568 to Crosslen; 3,756,421 to Wilkins; 3,788,489 to Cimino; 3,998,334 to Smith; 4,211,331 to Salmon et al.; and 4,614,272 to Shelton et al.

SUMMARY OF THE INVENTION

This invention is generally directed to a merchandising display stand having a plurality of interchangeable and selectively useable article support elements which may be selectively carried and supported with respect to an expandable or vertically extendable column so that a plurality of the support elements may be rotatably carried by the vertical support column in vertically spaced relationship with respect to one another. The vertical support column includes a plurality of interlocking support posts which are generally similarly designed to be interchangeable with one another and which are carried by a support base. Each of the vertical support posts includes an upper bearing surface defined by a female joint or socket and an outwardly extending flange upon which the article support elements including trays, racks and the like are rotatably seated. In some embodiments of the invention, a rotatable support bracket may be selectively carried by the bearing surface of one or more of the tiered vertical support posts so as to be rotatable with respect thereto and which is designed to support a plurality of separate shelf and/or hook elements so that a number of differing sizes and styles of merchandise may be displayed therefrom.

In a preferred form of the invention, the support brackets which are rotatably carried about the bearing surfaces of the vertical posts are molded of a plastic material having pairs of spaced upper and lower flange portions which define upper and lower channels in which sliding hook elements are slideably received. Each of the hook elements is adjustable along a portion of the length of the support brackets so as to be selectively positioned outwardly with respect to the vertical axis of the support column and is retained in generally fixed position by friction retaining stops which are integrally molded to the bracket elements.

In another embodiment of the invention, the bracket elements may support shelf-like trays having outwardly extending mounting flanges arms which engage the bracket and support the trays in horizontal and perpendicular relationship with respect to the vertical support column of the invention. In a further embodiment, separate shelves and/or hanger rack assemblies may be directly mounted to the support column in vertically spaced relationship to one another.

In addition, the upper portion of the display stand of the present invention may also include an advertising or other type of indicia display which is fixedly mounted to the uppermost vertical support column so that the indicia thereon is displayed to consumers.

It is a primary object of the present invention to provide a multi-purpose merchandising display stand which can be utilized either as a floor mounted display stand or as a countertop display stand and which has interchangeable article support elements or components which may be assembled thereto in order to allow a plurality of varying types of merchandise to be supported thereon.

It is another object of the present invention to provide a merchandising display stand having a plurality of vertical post elements each of which carries an upper bearing surface upon which an article display rack or tray may be selectively rotatably supported when the post elements are in locked relationship with respect to one another. In this respect, the display stand is generally formed of a plastic material with each of the bearing surfaces being formed of molded plastic elements which reduce the amount of friction between the article support trays and/or racks and bearing surface so as to permit a free rotation of the racks and/or trays with respect thereto.

It is also an object of the present invention to provide a merchandising display rack which enables a plurality of tiered and vertically spaced hook elements to be rotatably oriented about a vertical support column and maintained in outwardly spaced relationship with respect thereto so as to insure proper spacing of articles of merchandise supported therefrom during use.

It is another object of the present invention to provide a merchandising display rack which permits a plurality of differently packaged consumer goods to be displayed from a single support column and base so that hanging goods as well as shelf supported goods may be displayed upon a common stand and may be rotationally supported by the stand so as to permit the goods to be adjustably displayed.

Another object of the present invention is to provide a low cost and extremely durable display stand which can be utilized as a countertop display having a plurality of tiered rotational elements mounted thereto and which may be expanded to a floor type display without having to increase the support integrity of the vertically oriented column elements of the stand.

A yet further object of the present invention is to provide a display rack for articles of merchandise which can be easily assembled and disassembled without the use of any tools and which may be transported from one point to another by simply disengaging the components thereof from frictional engagement with respect to one another.

It is another object of the present invention to provide a merchandising display rack which is designed to be utilized not only in a permanent nature in a retail store but which may be utilized by sales personnel by having a plurality of interlocking components which may be easily disengaged and hand-carried from point to point and yet be assembled to provide either a floor or countermount display from which articles may be either supported or suspended from hook, tray or rack type components.

DESCRIPTION OF THE PREFERRED EMBODIMENT

Figure 1:
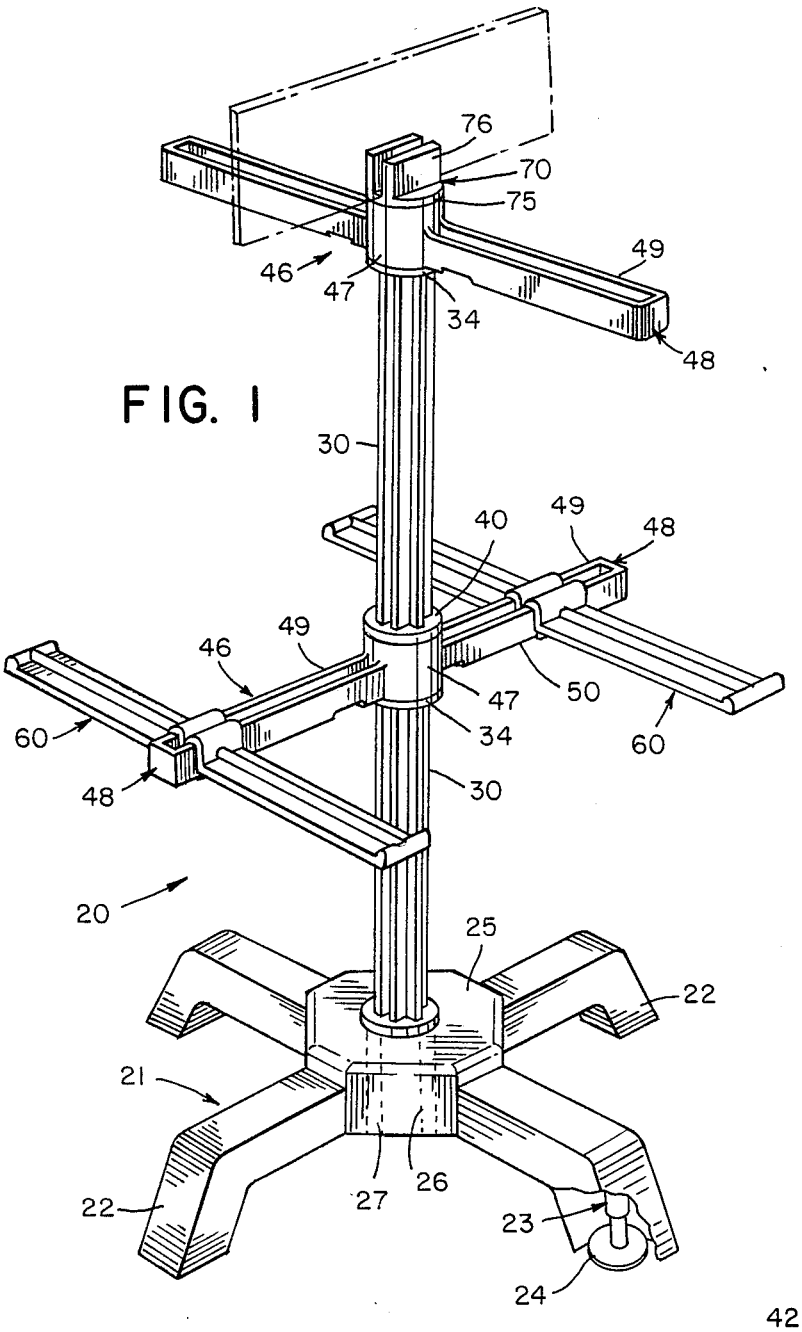
FIG. 1 is a perspective view of one embodiment of the merchandising display stand of the present invention.
Figure 2:
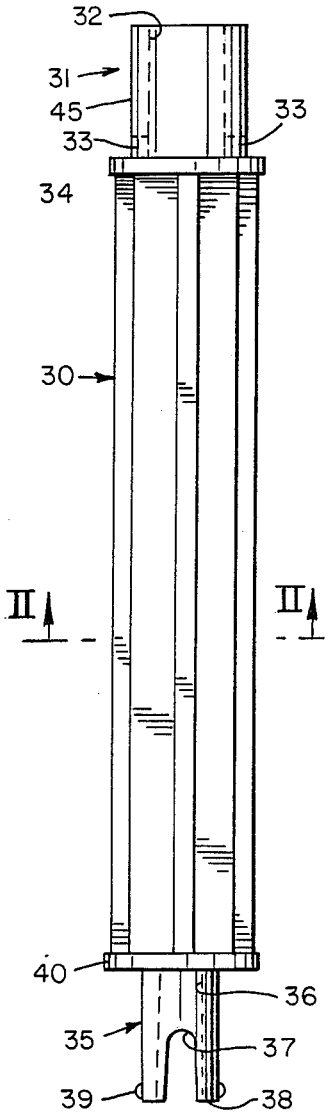
FIG. 2 is a front plan view of one of the interchangeable vertically oriented post members of the merchandising display stand of the present invention.
Figure 1A:
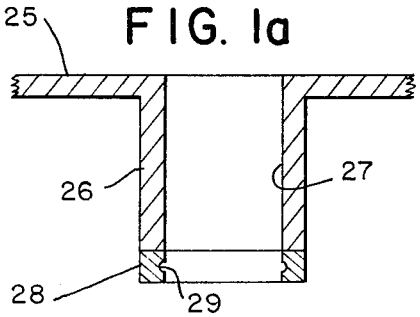
FIG. 1*a* is an enlarged cross sectional detailed view of the hub portion of the base which shows the central opening and the locking ring 28.

With continued reference to the drawings, the article merchandising support stand 20 of the present invention is shown in FIG. 1 as including a base member 21 having a plurality of outwardly and downwardly extending leg portions 22 which support the stand in stabilized relation with respect to a horizontal surface. Each of the leg portions includes a generally vertically oriented hollow sleeve 23 which frictionally receives the shaft of friction pad member 24 which are used to retain the base in non-slideable engagement with the support surface. The hub portion 25 of the base includes a central opening 26 which is defined by a depending annular wall or sleeve 27. A locking ring 28 is securely mounted in axial alignment with the lower portion of the annular sleeve 27 and includes a pair of spaced recesses or openings 29 therein for purposes of which will be described in greater detail hereinafter.

The merchandising support stand of the present invention is designed to be extendable to varying vertical elevations and includes a plurality of interchangeable vertical support posts 30. Each vertical support post 30 includes an upper female connecting socket 31 having annular side walls 32 defining a central opening therein. A pair of recesses 33 are provided through the base portion of each of the annular walls 32. An annular flange 34 extends outwardly perpendicularly with respect to the base portion of the annular walls 32 and provides a bearing surface for purposes of which will be described in greater detail hereinafter.

The lower portion of each of the vertical support posts 30 includes a hollow male locking member 35 having generally annular side walls 36. A pair of opposing notches 37 are made in the side walls and extend along a substantial portion of the length thereof in order to permit the end portions 38 to be compressible towards one another. A pair of locking detents 39 are also provided along the end portions 38 of the male locking members 35. In practice and when aligning one vertical support post with respect to another, the male end of one support post is inserted into the socket 31 defined by the side walls 32 in the adjacent support post and thereafter the male locking member 35 urged inwardly with respect to the female socket until the locking detents 39 engage in the recesses 33. In this position, the posts are retained in non-rotational assembled relationship with respect to one another. Due to this locking arrangement, the outer diameter of the male locking member 35 is generally equal to the inner diameter of the female connecting socket as defined by the inner surfaces of the annular walls 32. Upon insertion of the male member, the U-shaped openings therein will allow the end portions 38 of the male members to be compressed inwardly to permit the locking detents 39 to travel along the length of the female socket until being urged outwardly into the recesses 33. In a like manner, the male locking member of the lowermost post 30 will be selectively inserted in the opening 26 in the base and retained therein as the detents 39 engage within the recesses 29.

The male locking member 35 extends outwardly and perpendicularly with respect to a flange element 40 which is integrally molded or formed with the lower portion of the article support post. In this manner, when a pair of vertical support posts are locked into engagement with one another, the flanges 34 and 40 will provide spaced bearing surfaces for limiting the vertical movement of articles which will be rotatably supported about the female connecting socket 31.

Figure 3:
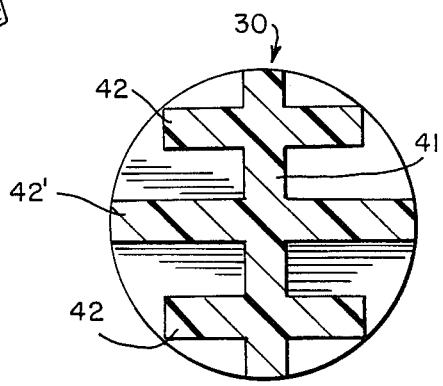
FIG. 3 is a cross sectional view taken along lines II—II of FIG. 2.

With particular respect to FIG. 3, the cross section of the support posts indicates that the posts are constructed having an elongated central rectangular portion 41 having oppositely oriented rib portions 42 extending perpendicularly with respect thereto. The central rib portions 42' are shown as extending outwardly a greater distance with respect to the central body portion 41. The cross sectional shape of the body is such as to define a circle when rotated through 360° .

Figure 5:
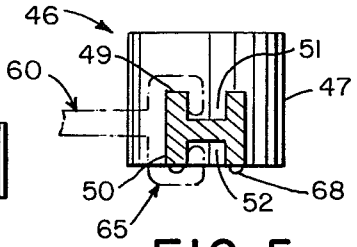
FIG. 5 is a cross sectional view taken along lines IV—IV of FIG. 4 showing the support hook of FIGS. 6 and 7 in dotted line.
Figure 4:
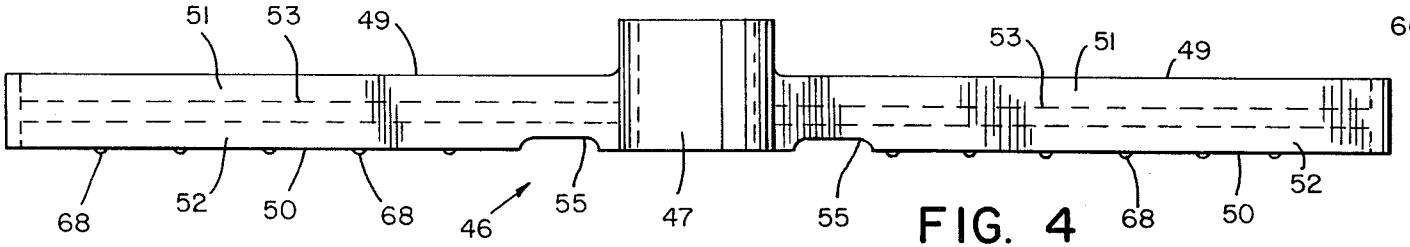
FIG. 4 is a front plan view of one of the support brackets used with the merchandising display stand of the present invention.
Figure 6:
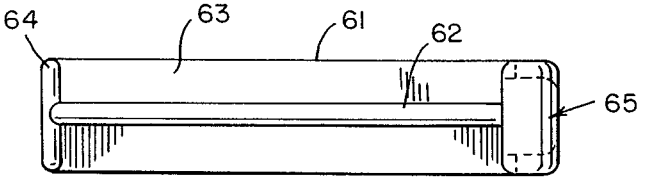
FIG. 6 is a top plan view of an article support hook which is removably secured to the merchandising support bracket shown in FIG. 4.
Figure 7:
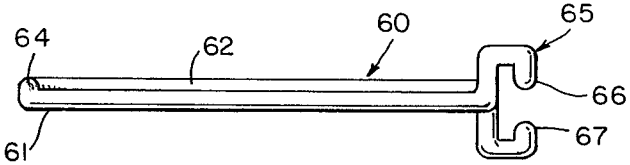
FIG. 7 is a side elevational view of the article support hook as shown in FIG. 6.
Figure 8:
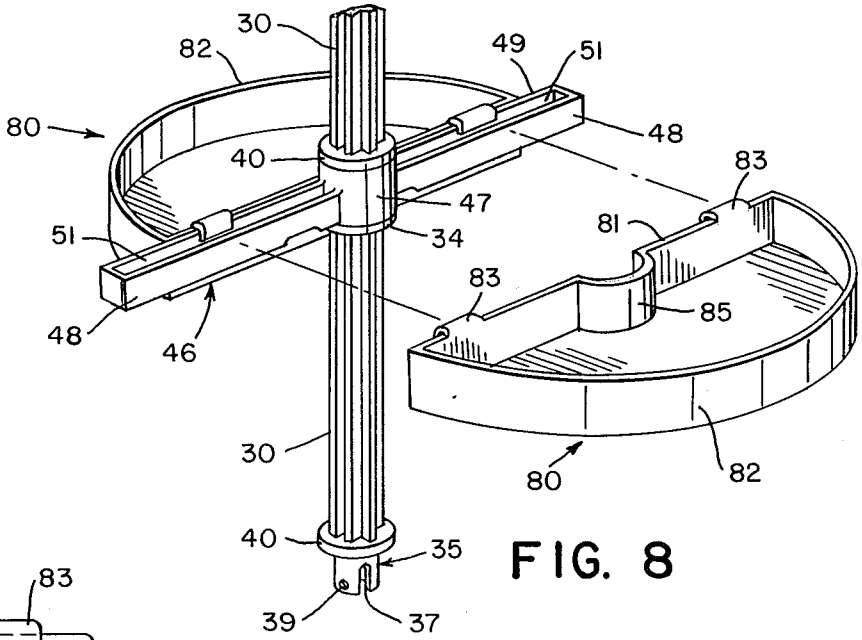
FIG. 8 is a perspective assembly view of a shelf element which may be selectively secured to the article support bracket shown in FIGS. 4 and 5.
Figure 8A:
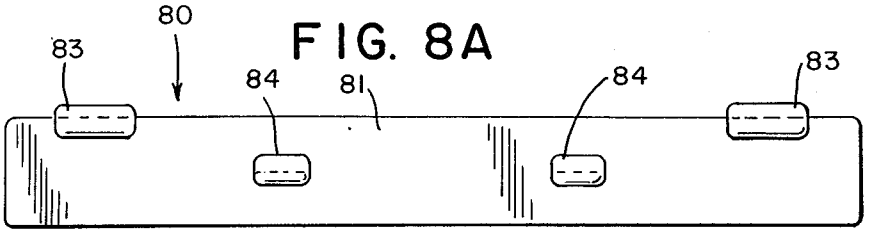
FIG. 8A is a rear elevational view of the trays shown in FIG. 8.

As previously mentioned, the outer walls of the female connecting sockets 31 of each of the support posts together with the adjacent flange elements 34 provide bearing surfaces about which various article support components may be selectively rotatably seated. With particular reference to FIGS. 1, 4 and 5, in a preferred form of the embodiment, a bracket member 46 is shown as being received about the bearing surface or outer walls 45 of the female socket 31 of each post 30. Each bracket member includes a central annular hub 47 having an opening therethrough which is of a diameter which is just slightly greater than the outer diameter defined by the walls 45 of the female connecting socket. The central hub 47 is adapted to be received over the female connecting socket and between the upper flange 34 of the lower support post 30 and the lower flange 40 of the adjacent upper support post. In addition, the length of the hub element 47 of each bracket member is substantially equal or slightly less than the distance between the flanges 34 and 40 when locking posts are assembled in locked engagement with respect to one another. In this manner, the hub portion of the bracket will permit the bracket to be freely rotatable within the bearing surface as defined between the joined post members.

Each rotary bracket further includes a pair of outwardly extending arm portions 48 which are diametrically opposed with respect to one another on either side of the hub 47. Each arm portion 48 is shown as having upper and lower generally U-shaped vertically extending wall portions 49 and 50, respectively. The U-shaped wall portions 49 and 50 define elongated recesses or channels 51 and 52 which are separated by an integrally formed web 53 which is disposed between the vertically extending walls 49 and 50 and generally perpendicular with respect thereto. As shown in FIG. 5 of the drawings, the cross sectional view taken through each of the arm portions 48 discloses that the cross section is in the form of an H wherein the reinforcing web 53 is integrally connected to the upper and lower wall portions 49 and 50.

A pair of opposing openings 55 are provided along each of the lower portions 50 of each arm portion 48 and adjacent the hub 47. The openings 55 are provided to permit one or more hanger elements 60 to be supported in adjustable relationship with respect to each outwardly extending arm 48. The hanger 60 includes an outwardly extending planar body 61 having a raised rib 62 disposed centrally along the upper surface 63 thereof which rib serves as a guide for the keyed openings in packaging. The ends have an upwardly extending lip 64 to prevent accidental displacement of articles carried on the hangers. The innermost portion of each hanger element includes generally C-shaped mounting clip portions 65 having upper and lower opposing retaining flanges 66 and 67, respectively. The C-shaped clips of each of the hanger elements 60 are designed to be cooperatively received and supported by the arms 48 of each of the brackets 46. With the C-shaped clip portions of each of the hanger elements aligned perpendicularly with the openings 55 in each arm, the upper flange 66 of the mounting element may be raised and lowered into the elongated recess 51 created between the upper vertically extending walls 49. Thereafter, by urging the bracket against the arm, the lower projection or flange 67 will pass inwardly of the openings 55 to be thereafter slidingly received along the lower channels 52 in each arm. The hanger elements may thereafter be adjusted along the length of each arm element and selectively positioned as desired.

In order to securely support each hanger element 60 in a fixed horizontal position relative to the hub 47 of each of the bracket members, a plurality of integrally formed raised stop members 68 are spaced along the lower vertical wall portion 50 of each arm of the bracket. Each of the stops is spaced apart a distance slightly greater than the width of each of the hanger elements. In this manner, the hanger elements may be frictionally urged over the stop members as the hanger elements are moved inwardly or outwardly with respect to the arms. Inadvertent movement of each of the hanger elements is thereafter prevented by the adjacent stop members.

With reference to FIG. 1 of the drawings, a countertop model or configuration of the support stand of the present invention is disclosed having a pair of vertically spaced bracket members rotatably carried by two support posts elements which are locked in engagement with one another. In order to retain the upper bracket member in revolving engagement with the female connecting end of the upper support post, a closure or header cap 70 is provided so as to be cooperatively received within the socket defined by the walls 32 of the adjacent post member. The cap is only utilized to finish off a vertical series or arrangement of support posts and complementary article support components. Each cap includes a vertically depending hollow male locking portion 71 which is defined by annular side walls 72. U-shaped openings 73 are provided in the lower portion of the side walls 72 for purposes of allowing the lowermost end elements thereof to be yieldable so as to be urged inwardly with respect to one another as has been described with respect to the male locking portion of each of the vertical posts. In order to lock the cap into place within the recess 39 defined by the adjacent vertical support post, a pair of lower detents 74 extend outwardly from the lower portion of the annular walls 72 and are of a size to be selectively received within the recesses 33 created in the female connecting socket portion of the adjacent vertical support post. An outwardly extending flange 75 limits the depth of penetration of the male locking portion of the cap member with respect to the adjacent support post. If desired, a pair of spaced flange members 76 may be integrally formed with the cap member and extend upwardly therefrom. A space is defined between the flange members 76 in which any type of display or identification card may be selectively received.

In the use of the adjustable merchandising stand of the present invention as shown in FIG. 1, after the lower support post 30 has been locked into engagement with the base 21, a first bracket member 46 is mounted over the bearing surface defined by the upper female connecting portion of the vertical support post. Thereafter, the second vertical post is mounted within the lower vertical support post and secured thereto by engagement of the locking detents 39 within the recesses 33 of the adjacent female connecting socket. A second bracket assembly 46 is thereafter placed in rotational engagement with the female end or connecting socket of the upper support post, and thereafter, a cap member 70 is engaged within the upper female connecting socket and secured as previously discussed. Afterward, any number of hanger elements 60 may be mounted on the upper and lower bracket members and spaced as desired to support whatever merchandise is to be displayed.

In the event it is desired to add additional tiers of rotary support brackets, additional vertical posts 30 and bracket members 46 are installed in assembled relationship in the same manner as discussed above with respect to the embodiment of FIG. 1.

In some instances, it may be desired to display merchandise other than by supporting such merchandise on hanger or hanger elements such as those shown at 60. As an alternative, the present invention utilizes varying forms of article display components as shown in FIGS. 8–11 of the drawings. With particular respect to FIG. 8 of the drawings, a merchandising tray 80 is disclosed having the general configuration of a half circle. The trays 80 are designed to be interlocked and carried by each of the support arms 48 of the bracket members 46. Each tray 80 includes an inner wall 81 and an outer arcuate wall 82. A pair of upper and lower mounting clips or flanges 83 and 84, respectively, are integrally formed with the inner wall 81 of the trays. Each of the mounting clips includes end portions which extend generally parallel with the wall 81 and which serve to engage the vertically extending upper and lower walls 49 and 50 of each of the arm elements of the bracket. The mounting elements are slightly flexible so as to permit the upper clips 83 to be inserted within the elongated recess 51 in the bracket arms and thereafter the shelf and rotated with respect to the arms until the locking clips 84 engage within the lower elongated recesses 52. As shown, two of the shelves 80 may be secured to each arm element of the bracket. As the shelf elements 80 will be mounted along the entire length of each bracket, the central portion of the wall element 81 includes a concavely shaped portion shown at 85 which permits clearance for the hub portion 47 of each bracket.

Figure 10:
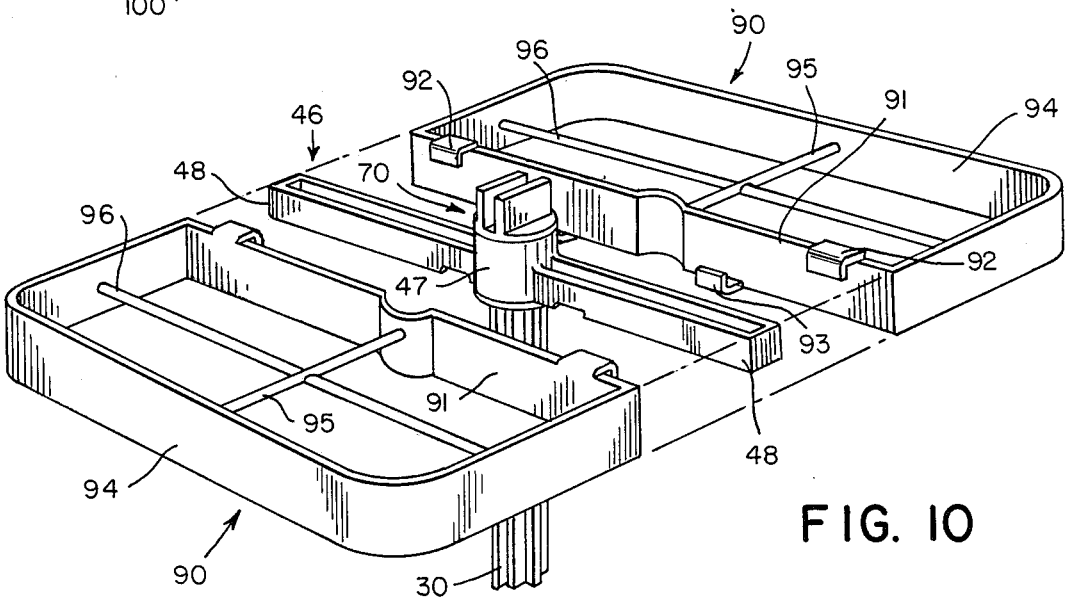
FIG. 10 is an alternate embodiment of an article support rack which may be utilized and suspended from the article support bracket shown in FIGS. 4 and 5.

With particular reference to FIG. 10, as opposed to utilizing a solid support tray, it may be desired to utilize an open support rack configuration such as that disclosed at 90. The rack 90 includes an inner wall portion 91 having pairs of spaced upper and lower mounting flanges or clips 92 and 93, respectively, extending therefrom. The mounting clips 92 and 93 are shaped identically to the mounting clips 83 and 84 utilized with the semi-circular tray elements 80. Each of the mounting clips is adapted to be received within the elongated recesses 51 and 52 formed in the arms of the brackets 46. The size of each clip element is also suitable to insure that an opposing rack member may be mounted within the same recesses 51 and 52 without obstruction to the opposing rack member. Each rack assembly 90 also includes an outer generally U-shaped wall portion 94 which is integrally connected at its ends to the inner wall 91. A pair of intermediate merchandising support rods 95 and 96 are mounted between the in wall 91 and outer walls 94. Support rod 95 extends from the intermediate portion of the inner wall 91 to the intermediate outer portion of the outer wall 94 while the support rod 96 extends generally parallel with respect to the support rod 95 and is supported at its end by the outer wall 94. The rack configuration shown in the drawings is condusive to supporting items of jewelry such as chains, pendants, necklaces and the like.

Figure 9:
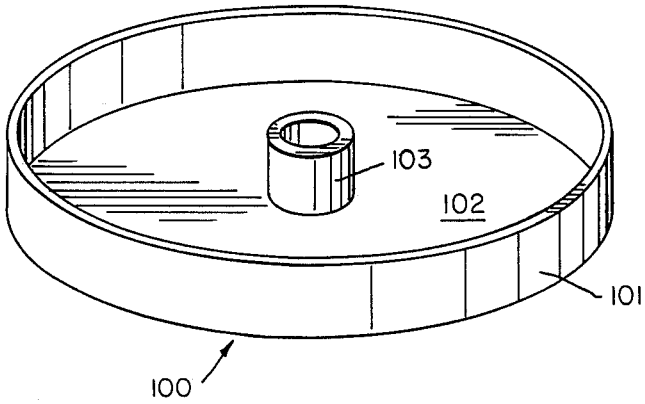
FIG. 9 is a rotatable article support tray which may be directly supported by the interconnecting vertical posts of the present invention.
Figure 11:
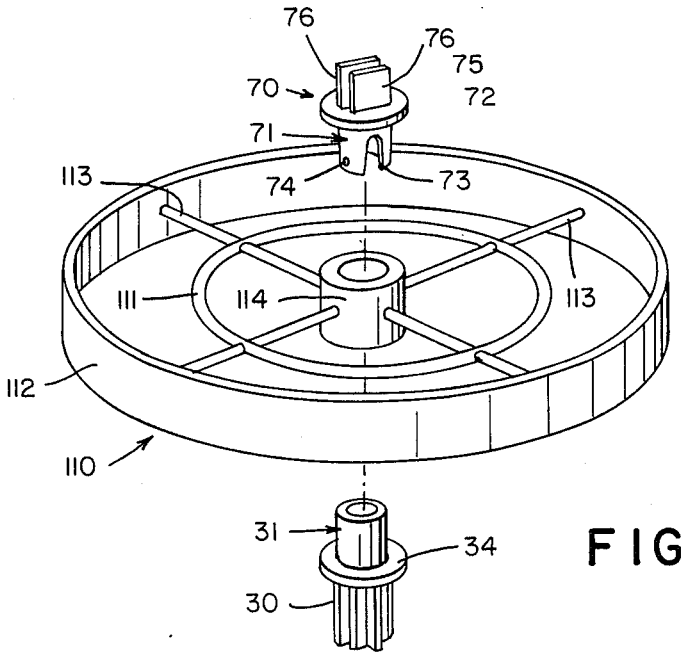
FIG. 11 is an annular article support rack from which articles of merchandise may be suspended and which is rotatably carried in the bearing surfaces between the vertical support posts of the present invention.

In the event it is desired to display larger articles of merchandise from the display stand, the vertical support post may be utilized to rotatably support circular merchandising shelves 100 as shown in FIG. 9 or generally circular merchandising racks 110 as shown in FIG. 11. The merchandising trays or shelves 100 are designed having an outer upstanding circular wall 101 which defines the perimeter of the tray support surface 102. A central sleeve 103 is provided in the middle of the shelf element and defines an elongated opening which is generally the same dimension as the openings through the bracket members 46 as discussed above. In a like manner, the sleeve 103 is generally of the same vertical extension and dimension as each of the hub portions 47 of the bracket members. The round tray or shelf elements are therefore adapted to be fitted directly over the female connecting or end portions of each of the vertical support posts so as to be rotatable with respect thereto and between the spaced flange elements 34 and 40 of one post and an adjacent post.

The circular article display rack 110 also is designed to be directly supported about the female connecting end portions of the vertical support posts. The circular racks 110 include inner and outer concentric annular support elements 111 and 112 which are maintained in spaced relationship with respect to one another by radially extending bracket portions 113. The radial bracket portions are generally equally spaced around and extend from a central annular sleeve 114 which is of the same size and configuration as the sleeve 103 discussed above with respect to the shelf configuration shown in FIG. 9. An opening is provided within the sleeve 114 for purposes of permitting the rack to be mounted over the female connecting end portion of a vertical support post. As with the embodiment of the merchandising tray disclosed in FIG. 9, the merchandising rack of FIG. 11 is rotatably mounted with respect to the support post so as to enable the rack to be oriented through 360° to allow a consumer to inspect any articles displayed around the entire periphery of the rack.

In the use of the invention with the elements disclosed in FIGS. 8–11, any of the alternative tray or rack configurations may be selectively utilized with the vertical support posts of the present invention. In various combinations, the rotary brackets 46 may be utilized to support pairs of rack elements 90 or tray elements 80. In some instances, the brackets may be removed and replaced by the rotary tray or shelf shown in FIG. 9 or the rotary rack disclosed in FIG. 11. Alternatively, varying combinations of rotary racks, trays, brackets and hooks may be utilized as desired by the merchandiser. Therefore, a plurality of varying sizes and configurations of merchandise may be selectively displayed on a common vertical support with such displays being selectively altered as desired by the merchandiser.

I claim:

1. A merchandising display stand for selectively supporting a plurality of varying types of merchandise comprising a base having an opening generally centrally thereof, post means having upper and lower end portions, said lower end portion of said post means including a bifurcated locking member having a pair of spaced leg portions being receivable within said opening in said base, a bearing flange adjacent said lower end portion and being engagable with said base outwardly of said opening, means for retaining said post means within said opening in said base, said upper end of said post means having an open socket defined by annular side walls having upper and lower portions, a perpendicularly extending flange member positioned adjacent said lower portion of said annular side walls defining said socket, merchandise support means selectively carried by said post means, said merchandise support means including a central sleeve having an opening therethrough, said opening in said central sleeve being of a size to permit said central sleeve to be received around said annular side walls defining said socket member, said merchandise support means being seated against said flange member and freely rotatable with respect to said post means, and means receivable within said socket of said upper portion of said post means for preventing the vertical movement of said merchandise support means.

2. The merchandising display stand of claim 1 in which said merchandise support means includes tray means extending outwardly from said central sleeve, said tray means being substantially symmetrically oriented about said central sleeve, and upwardly extending wall portions defining the periphery of said tray means.

3. The merchandising display stand of claim 1 in which said merchandise support means includes a plurality of bar means extending radially outwardly from said central sleeve, at least two concentrically oriented article support means supported by said radially extending bar means for supporting articles of merchandise therefrom.

4. A merchandising display stand for supporting a plurality of varying sizes and types of merchandise comprising a base member having an opening therein, at least two interchangeable post means selectively mounted in vertical relationship with respect to said base member, each of said post means having upper and lower end portions which are aligned along a common axis, said upper end portion including an annular wall portion which defines an upwardly open socket, a first outwardly extending flange spaced immediately adjacent said annular wall portion, said lower end portion of said post means having a depending engaging means extending therefrom, said depending engaging means having a pair of spaced end portions which are yieldable with respect to one another, said depending engaging means being of a size to be slideably and selectively received within one of said openings in said base member and said socket of an adjacent post means so that said post means may be connected in end to end relationship with respect to one another, a second outwardly extending flange disposed immediately adjacent said depending engaging portion, locking means for retaining said depending engaging means in fixed relationship to one of said base member and said socket of an adjacent post means, a bracket means carried between two of said post means, said bracket means including a central sleeve having an opening therein and arm portions which extend outwardly generally perpendicularly with respect to said post means, said opening in said sleeve being of a size to permit said bracket means to be rotatably engaged about said annular wall portion of said upper end of one of said post means, said sleeve means extending between said first and second flange means between two of said post means and being cooperatively seated and retained in freely rotatable relationship there between when said post means are connected in end to end relationship, at least one merchandise support means mounted to said arm portions of said bracket means, each of said merchandise support means including at least one clip means for selectively engaging said arm portions of said bracket means, whereby said merchandise support means are freely rotatably mounted with respect to said post means.

5. The merchandising display stand of claim 4 in which said locking means includes a projection means mounted on each of said end portions of said depending engaging means of said lower end portion of said post means, a pair of spaced openings within said annular wall portion defining said open socket in said upper end portion of said post means, said projection means being spaced so as to be cooperatively received within said openings in said annular wall portion when said depending engaging means of said lower end of one of said post means is inserted into said socket means of an adjacent of said post means.

6. The merchandising display stand of claim 5 including a pair of spaced recesses provided along said opening in said base member, said recesses being oriented so as to selectively receive said projection means of said depending engaging means of said lower end portion of said post means.

7. The merchandising display stand of claim 4 in which said outwardly extending arm portions of said bracket means are integrally formed with said central sleeve, each of said outwardly extending arm portions having spaced upwardly and downwardly vertically oriented wall portions defining elongated recesses therebetween, and and said clip means of said merchandise support means being mounted within said recesses.

8. The merchandising display stand of claim 7 in which said merchandise support means includes an elongated body portion, said said body portions having an outer end and inner end said inner end including said clip means, said clip means having upper and lower flange means which are engagable within said elongated recesses of said arm portions of said bracket means, said merchandise support means being selectively slideably disposed along said arm portions of said bracket means.

9. The merchandising display stand of claim 8 in which said elongated elongated body portion includes a raised lip along said outer end thereof and a raised rib member extending between said inner and outer ends.

10. The merchandising display stand of claim 8 including openings in said downwardly oriented wall portions of each of said arm portions, said openings being of a size to permit said lower flange portion of said clip means to be urged therethrough into sliding engagement with said elongated recesses of said arm means.

11. The merchandising display stand of claim 10 including a plurality of integrally formed and spaced projections along each of said arm portions, each of said projections being spaced apart a distance greater than the width of said hanger means.

12. The merchandising display stand of claim 11 in which said projections are formed along said downwardly oriented wall portion of said arm portions.

13. The merchandising display stand of claim 7 in which said merchandise support means includes a first and second opposing tray means, each of said first and second opposing tray means having at least one pair of upper and lower mounting clip means integrally formed therewith, said first and second tray means being selectively suspended from said arm portions so as to extend along substantially the entire length of said bracket means.

14. The merchandising display stand of claim 7 in which said merchandise support means includes at least one open rack means having inner and outer wall portions, said clip means being integrally formed with said inner wall portions, said clip means having upper and lower portions which are engagable in opposing relationship within said elongated recesses in said arm portions of said bracket means, said rack means having intersecting article support means disposed inwardly of said inner and outer wall portions thereof.

15. The merchandising display stand of claim 14 including at least two of said open rack means, said open rack means being mounted in oppositely oriented relationship with respect to one another along said arm portions of said bracket means.

16. A merchandising display stand for supporting a plurality of varying sizes and types of merchandise comprising a base member having an opening therein, at least two interchangeable post means selectively mounted in vertical relationship with respect to said base member, each of said post means having upper and lower end portions which are aligned along a common axis, said upper end portion including an annular wall portion which defines an upwardly open socket, a first outwardly extending flange spaced immediately adjacent said annular wall portion, said lower end portion of said post means having a depending engaging means extending therefrom, said depending engaging means being of a size to be slideably and selectively received within one of said openings in said base member and said socket of an adjacent post means so that said post means may be connected in end to end relationship with respect to one another, a second outwardly extending flange disposed immediately adjacent said depending engaging portion, a bracket means carried between two of said post means, said bracket means including a central sleeve having an opening therein and outer extending arm portions, said opening in said sleeve being of a size to permit said bracket means to be rotatably engaged about said annular wall portion of said upper end of one of said post means, said sleeve means extending between said first and second flange means between two of said post means and being cooperatively seated and retained in freely rotatable relationship therebetween when said post means are connected in end to end relationship, a first merchandise support means having an elongated body portion having inner and outer ends, said inner ends having first clip means for selectively engaging said arm portions of said bracket means, second merchandise support means including upwardly oriented peripheral wall portions, one of said wall portions being generally parallel to said arm portions of said bracket means, and a pair of clip means extending from said one of said wall portions for selectively engaging said arm portions of said bracket means whereby said first and second merchandise support means may be selectively mounted and oriented with respect to one another to provide support for various types of merchandise.

17. The merchandise display stand of claim 16 wherein said second merchandise support means includes a tray for supporting merchandise therein, and third merchandise support means including a hanger means, said hanger means including outer wall portions and inner support bars, one of said outer wall portions being generally parallel to said arm portions of said bracket means, and third clip means extending from said one of said outer wall portions for selectively engaging said arm portions of said bracket means.

18. The merchandise display stand of claim 16 in which said first merchandise support means is selectively slideable along said arm portions of said bracket means.

* * * * *